United States Patent [19]

Rodell

[11] 4,393,621

[45] Jul. 19, 1983

[54] TREE HOLDER

[76] Inventor: Clifford H. Rodell, 8749 Contee Rd., Laurel, Md. 20811

[21] Appl. No.: 315,712

[22] Filed: Oct. 28, 1981

[51] Int. Cl.[3] ..... A47G 7/02

[52] U.S. Cl. ..... 47/40.5; 248/524

[58] Field of Search ..... 47/40.5, 42, 43, 44, 47/47, 41, 45, 46; 248/524, 529, 528, 523, 525, 526, 527, 519, 514, 522; 403/234, 237, 190, 191

[56] References Cited

U.S. PATENT DOCUMENTS

| | | | |
|---|---|---|---|
| 387,007 | 10/1885 | Coffin | 248/524 |
| 919,981 | 4/1909 | Unger | 248/514 X |
| 1,082,787 | 6/1912 | Rossmeissl | 248/529 X |
| 1,597,266 | 8/1926 | Dearman | 248/514 |
| 1,943,269 | 1/1934 | Holden | 47/40.5 X |
| 2,516,802 | 7/1950 | Richards et al. | 248/523 |
| 2,681,780 | 6/1954 | Santoro | 47/40.5 |
| 2,821,353 | 1/1958 | Hasenohrl | 248/527 X |

FOREIGN PATENT DOCUMENTS

| | | | |
|---|---|---|---|
| 1294615 | 5/1969 | Fed. Rep. of Germany | 47/40.5 |

*Primary Examiner*—James R. Feyrer
*Assistant Examiner*—Danton D. DeMille
*Attorney, Agent, or Firm*—Antonelli, Terry & Wands

[57] ABSTRACT

A first embodiment of the invention is a tree holder which is comprised of a base and three or more orthogonally projecting members which are pivotably attached to the base at spaced apart locations which define a polygon. The distance between the members, which is varied by their pivoting, determines the maximum diameter of the stem of a tree which may be supported by the holder. The members project orthogonally from the base a distance along the stem of the tree to a position where branches of the tree engage the stem when the end of the trunk touches the base. The base has means for holding the end of the trunk at least partially within the area of the polygon. The members each contain a section offset from the point of attachment which is pivoted and locked in an angular position to engage the branches or the stem of the tree.

A second embodiment of the invention is a tree holder which is comprised of a base and three or more orthogonally projecting members which are fixedly attached to the base. The base has means for holding the bottom surface of the trunk at least partially within the area of the polygon defined by the points of attachment of the members of the base.

15 Claims, 6 Drawing Figures

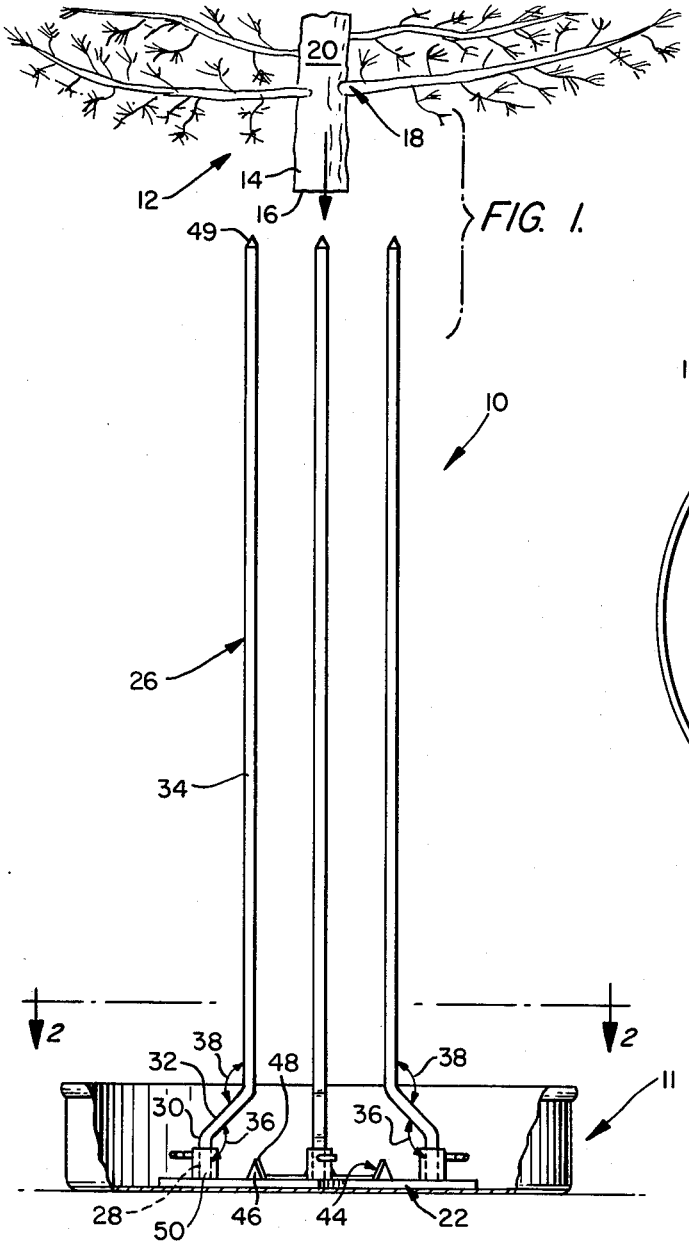
FIG. 1.
FIG. 2.
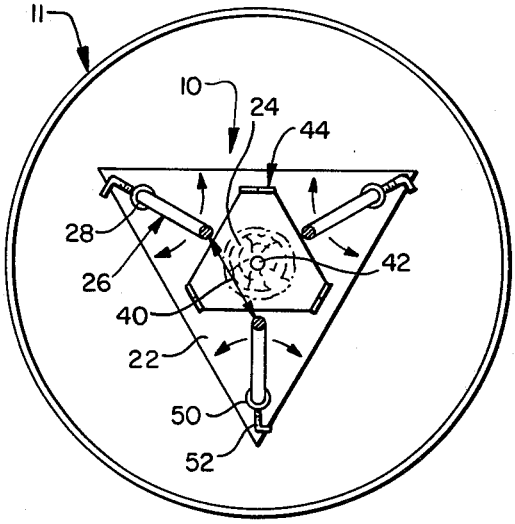
FIG. 3.
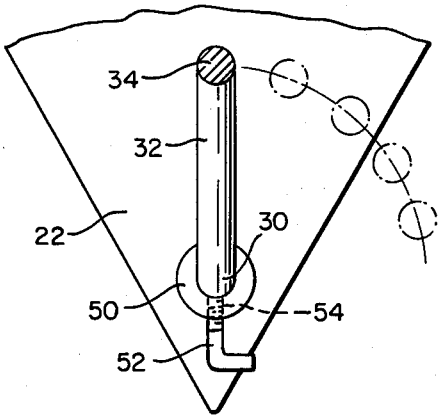
FIG. 4.
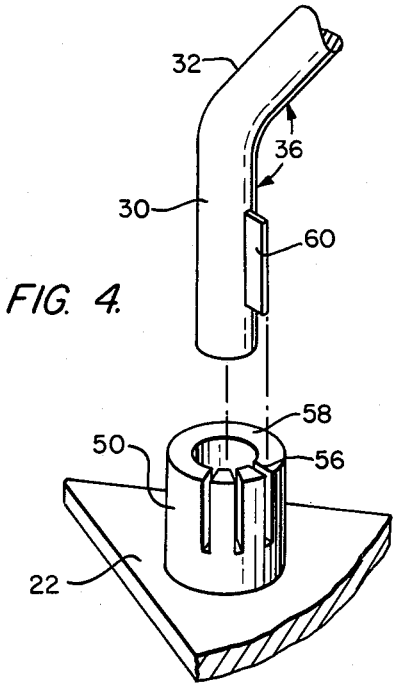

TREE HOLDER

BACKGROUND OF THE INVENTION

1. Field of the Invention

The invention relates to holders for supporting trees in an upright position.

2. Description of the Prior Art

Numerous holders have been developed for holding Christmas trees in an upright position. These holders include structures which must be adjusted to engage the cylindrical surface of the trunk at a position displaced from the end of the trunk below the point where the branches join the stem of the tree. These holders usually include additional structure, such as a spike, which is secured to the base of the holder for holding the end of the trunk in a fixed position. Examples of the aforementioned type of tree holders are described in U.S. Pat. Nos. 283,392; 1,110,142; 1,505,357; 1,694,815; 1,732;284; 1,873,471; 2,476,225; 2,699,308; 2,755,049; 2,755,050; 3,293,802; 3,136,514; 3,350,043; 3,591,114; 3,697,026; 4,006,560 and 4,254,578, German Pat. Nos. 743,053 (1943) and 26 50 973 and Swedish patent 79361 (1931).

In addition to the aforementioned types of tree holders, holders have been made which have a base and three or more orthogonally projecting members which are attached to the base at fixed locations. The members project from the base up to a point on the stem where the branches engage the stem when the end of the trunk touches the base.

SUMMARY OF THE INVENTION

The embodiments of the present invention differ from the Christmas tree holders disclosed in the aforementioned patents in not having structure which must engage the cylindrical surface of the trunk of the Christmas tree to secure tree in an upright position.

The first embodiment of the invention holds trees in a secure upright position by pivoting of the members to an angular position where they engage the branches or the stem of the tree and locking them in place. The pivoting of the members to an angular position and locking them in place so they engage the branches or the stem of the tree minimizes the possibility that the tree may be moved from its desired perpendicular position with respect to the horizontal base without encountering resistance from the members.

The embodiments of the invention have structure for engaging the end of the trunk either totally within or partially within the polygon defined by the points of attachment of the members to the base. The structure includes a pointed member located between each adjacent pair of vertices of the polygon. The structure permits trees with crooked stems or trunks to be placed in a secure upright position.

A tree holder in accordance with the first embodiment of the invention includes a base upon which a trunk of at tree rests when the tree is being held in a upright position; at least three orthogonally projecting members which are attached to a surface of the base at spaced apart locations which define a polygon, eadh orthogonally projecting member having a first section, a second section joined to the first section which is not parallel to the first section, and a third section joined to the second section, the first section being parallel to the third section, the first section of each member being attached to the base, each member projecting a distance from the base such that it extends along the trunk of a tree to the stem where the branches join the stem when the end of the trunk touches the base; means for permitting the members to be pivoted with respect to the base; and means for locking each member in a fixed angular orientation with respect to the base.

A tree holder in accordance with the second embodiment of the invention includes a base upon which the end of a trunk of a tree rests when the tree is being held in an upright position, at least three orthogonally projecting members attached to a surface of a base at spaced apart locations which define a polygon, each member projecting a distance from the base such that it extends along the trunk to the stem where the branches join to the stem when the end of the trunk touches the base and means attached to the base for holding the end of the trunk at least partially within the area of the polygon defined by the points of attachment of the members to the base, the means having a pointed member located between each adjacent pair of vertices of the polygon.

BRIEF DESCRIPTION OF THE DRAWINGS

FIG. 1 is an elevational view of a tree holder in accordance with the invention;

FIG. 2 is a top view of the holder of FIG. 1;

FIG. 3 is a view of the mechanism of FIG. 2 for clamping the orthogonally projecting members in a fixed angular position;

FIG. 4 is a view of a second type of mechanism for clamping the orthogonally projecting members in a fixed angular position;

DESCRIPTION OF THE PREFERRED EMBODIMENTS

Figure 5:
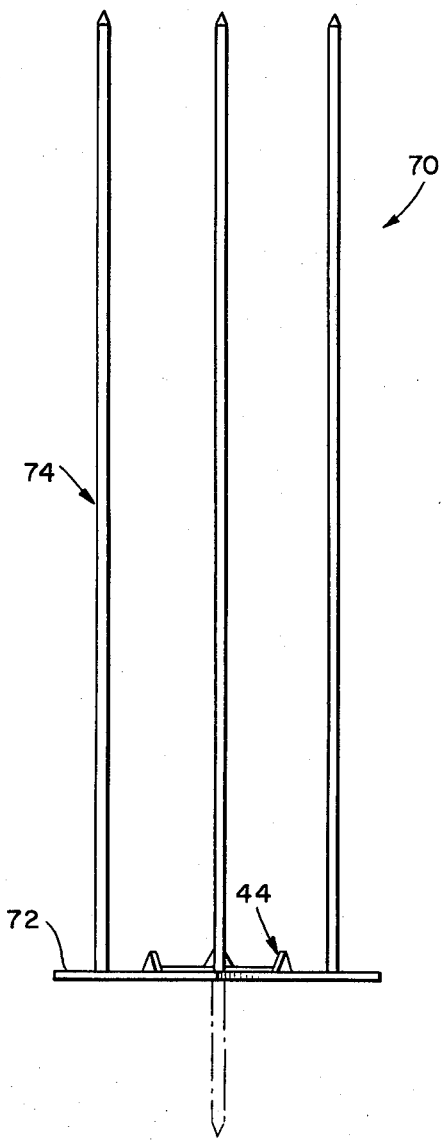
FIG. 5 is an elevational view of a second embodiment of the invention which has fixed orthogonally projecting members.

FIGS. 1 and 2 illustrate a tree holder 10 in accordance with the invention which is designed for the indoor display of trees. The holder 10 is used for indoor display by integrally forming the base of the stand with a vessel 11 for containing water to be supplied to the tree or by providing a mechanism (not illustrated) for securing the base immovably within a vessel. The Christmas tree 12, includes a trunk 14 which extends from end 16 up to the first whorl of branches 18. The stem 20 is the axial section of the tree 12 where the branches 18 are located. A whorl is a group of radially projecting branches 18 in a coniferous tree which is located at the same axial position on the stem 20 to which the branches are joined. Three or more orthogonally projecting members 26 are pivotally joined to the base 22 at spaced apart locations 28 which define a polygon 24. Preferably, the locations 28 define an equilateral polygon 24. When a tree is being held, the members 26 project a distance measured from the base 22 along the length of the trunk 14 of the tree 12 to the stem 20 where the branches 18 of the tree are located. The individual members 26 have a first section 30 which rotates upon base 22, a second section 32 joined to the first section and a third section 34 which is joined to the second section 30 and is parallel to the first section 30. The angles 36 and 38 which are respectively defined by the intersection of the first and second sections 30 and 32 and the second and third sections 32 and 34 may be chosen to be any size as long as the third section is offset with respect to the first section. The maximum diameter stem 20 which the holder 10 may hold is determined by the distance 40 between the third section 34. While the invention is not limited thereto, it is preferred that the members 26 project from the base 22 along the trunk 14 to a point between the fourth and seventh remaining whorls of branches on the stem 20. The projection of the members 26 to a position along the stem 20 between the fourth and seventh whorls insures that the members engage enough branches 18 of the tree to hold the tree in secure upright position. The element 44, which functions to retain the end 16 at least partially within polygon 24 to insure stability, has sections 46, equal in number to the number of sides of polygon 24, which project from the base 22. Each section 46 has a point 48. When the tree being held has a crooked trunk, the points 48, which are preferably located midway between adjacent vertices of the polygon 24, engage the end 16 even when it only falls partially within the area of the polygon. The location of the sections 46 coextensive with the sides of the polygon 24 maximizes the number of trees with crooked trunks or stems which may be securely held. Moving the sections 46 in toward the centroid of the polygon 24 lessens the crookedness of the tree which may be securely held by the invention. Moving sections 46 out past the sides of polygon 24 reduces the stability because the ends 16 have more freedom of movement. The stability of the tree 12 is enhanced by the containment of the end 16 partially within the polygon 24 when the end rests on or is penetrated by one or more of the points 48. When a tree with a straight trunk 14 is being held, the end 16 falls totally within the polygon 24. Containment of the end within the polygon 24 enhances stability. The ends 49 of the members 26 are pointed to facilitate the lowering of the tree 12 down into contact with the holder 10 without having the members being caught on the branches 18. It has been found that three members 26 is thwe optimum number, but a greater number may be used. Less than three members 26 does not provide sufficient upright stability and greater than three makes it more difficult to lower a tree down into engagement with the holder because the ends 49 tend to become caught on the branches 18.

FIGS. 3 and 4 illustrate in detail the structure of the first embodiment for locking the members 26 in a fixed angular position. The end of each first section 30 of the members 26 is rotatably supported on base 22 by a bushing 50, which is joined to the base 22 at the locations 28. The locking mechanism of FIG. 3 is comprised of a set screw 52 which engages threads 54 within the bushing 50. Each of the set screws 52 is turned, after positioning the associated members 26 in the desired angular positions, to positively engage the surface of the associated member 26 with sufficient force to prevent rotation. The locking mechanism of FIG. 4 is comprised of a series of radial slots 56 located within the cross section 58 of bushing 50 which engage a projection 60 located on each member 26. The locking of the member 26 with the locking mechanism of FIG. 4 is accomplished by lifting it sufficiently to clear the projection 60 from the slots 56, rotating the member to the desired angular orientation and dropping the member down so that the projection engages the slot 56. Other forms of locking mechanisms may be used to lock the angular position of the member 26 with respect to the base 22.

Figure 6:
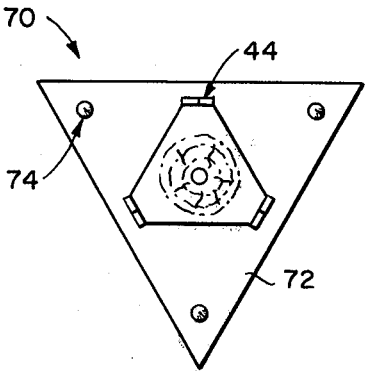
FIG. 6 is a top view of the second embodiment of the invention.

FIGS. 5 and 6 illustrate a second embodiment of the invention 70 having orthogonally projecting members 74 non-rotatably attached to the base 22. The second embodiment has an element 44 identical to the element 44 of the first embodiment described supra to stabilize the tree within the holder. Identical reference numerals have been used to identify like parts in FIGS. 1 and 2 and 5 and 6. The second embodiment of the invention is an improvement of the prior art tree holders, which have orthogonally projecting members which are non-rotationally mounted to the base, for the reason that these prior tree holders did not have any structure for retaining the end of the trunk of a tree within any area. The members 70 have fixed points of attachment 72 to the base 22. The element 44 of the second embodiment performed the same function as it performed in the first embodiment. A ground engaging spike has been illustrated in phantom to suggest the use of the invention as an outdoor stand.

While the invention has been described as a preferred embodiment, it is intended that numerous modifications may be made to the invention without departing from its spirit and scope.

I claim:

1. A stand for holding trees in an upright position comprising:

(a) a base upon which the end of a trunk of a tree rests when the tree is being held in an upright position;

(b) at least three orthogonally projecting members attached to a surface of the base at spaced apart locations which define a polygon, each member projecting a distance from the base such that it extends along the trunk to the stem where the branches join to the stem when the end of the trunk touches the base; and (c) means attached to and extending upwardly from the base for holding the end of the trunk at least partially within the area of the polygon defined by the points of attachment to the members of the base, the means having a pointed member located on a line extending between each adjacent pair of vertices of the polygon.

2. A stand in accordance with claim 1 wherein each pointed member is located on the line extending between a pair of adjacent vertices of the polygon midway between the pair of vertices.

3. A stand in accordance with claim 2 wherein the polygon is equilateral.

4. A stand in accordance with claim 3 wherein the at least three members project orthogonally a distance such that the members engage at least the fourth whorl of branches of a tree when the end of the trunk engages the means for holding the trunk in a fixed area located on the surface of the base.

5. A stand in accordance with claim 4 wherein the at least three members are each cylindrical rods and the end of each rod which is not attached to the base is pointed.

6. A stand for holding trees in an upright position comprising:

(a) a base upon which the end of a trunk of a tree rests when the tree is being held in an upright position;

(b) at least three orthogonally projecting members attached to a surface of the base at spaced apart locations which define a polygon, each orthogonally projecting member having a first section, a second section joined to the first section which is not parallel to the first section and a third section joined to the second section which is not parallel to the second section, the first section being parallel to the third section, the first section of each member projecting orthogonally from the base, each member projecting a distance from the base such that it extends along the stem where the branches join to the stem when the end of the trunk touches the base;

(c) means for permitting each of the members to be individually pivoted with respect to the base to permit the third section of each member to be locked into engagement with the branches;

(d) means for locking each member in a fixed angular orientation with respect to the base; and (e) means attached to the base for holding the end of the trunk at least partially within the area of the polygon defined by the points of attachment of the members to the base, the means having a pointed member located between each adjacent pair of vertices of the polygon.

7. A stand in accordance with claim 6 wherein each pointed member is located on a line extending between a pair of adjacent vertices of the polygon midway between the pair of vertices.

8. A stand in accordance with claim 7 wherein the polygon is equilateral.

9. A stand in accordance with claim 8 wherein the at least three members project orthogonally a distance such that the members engage at least the fourth whorl of branches of a tree when the end of the trunk engages the means for holding the trunk in a fixed area located on the surface of the base.

10. A stand in accordance with claim 9 wherein the at least three members are each cylindrical rods and the end of each rod which is not attached to the base is pointed.

11. A stand in accordance with claim 10 wherein:

(a) the means for pivotably attaching each member to the base comprises a bushing joined to the base at the point of attachment of the member to the base, each bushing having a cylindrical aperture for receiving the member; and (b) the means for locking comprises a plurality of slots cut radially in a cross section of the bushing along the axis of the aperture of the bushing and a projection joined to the outside surface of each member, the projection of each member engaging one of the slots of its associated bushing when the member is locked in place.

12. A stand in accordance with claim 11 wherein the three members are each cylindrical rods and the end of each rod which is not attached to the base is pointed.

13. A stand in accordance with claim 10 wherein:

(a) the means for pivotally attaching each member to the base comprises a bushing joined to the base at the point of attachment of the member to the base, each bushing having a cylindrical aperture for receiving the member; and (b) the means for locking comprises a set screw which is held within the bushing by a threaded hole, the set screw engaging the cylindrical surface of the member when it is locked in a fixed angular position.

14. A stand in accordance with claim 13 wherein the stand is contained in a vessel adapted to hold water.

15. A stand for holding trees in an upright position comprising:

(a) a base upon which the end of a trunk of a tree rests when the tree is being held in an upright position;

(b) at least three orthogonally projecting members attached to a surface of the base at spaced apart locations which define a polygon, each orthogonally projecting member having a first section, a second section joined to the first section which is not parallel to the first section and a third section joined to the second section which is not parallel to the second section, the first section being parallel to the third section, the first section of each member projecting orthogonally from the base, each member projecting a distance from the base such that it extends along the stem where the branches join to the stem when the end of the trunk touches the base;

(c) means for permitting each of the members to be individually pivoted with respect to the base so that the third section of each member may be rotated with respect to the base to engage the branches of the tree to permit the third section of each member to be locked into engagement with the branches; and (d) means for locking each member in a fixed angular orientation with respect to the base to permit the third section of each member to be locked into engagement with the branches.

* * * * *